US005119872A

United States Patent [19]

Engebretson

[11] Patent Number: 5,119,872

[45] Date of Patent: Jun. 9, 1992

[54] ARCUATELY ADJUSTABLE ROLLER AND CORNER KEY FOR SLIDING SCREEN DOOR

[75] Inventor: David C. Engebretson, Tampa, Fla.

[73] Assignee: JW Window Components, Inc., Tampa, Fla.

[21] Appl. No.: 733,020

[22] Filed: Jul. 30, 1991

[51] Int. Cl.[5] ..... E05D 13/02

[52] U.S. Cl. ..... 160/381; 16/105; 49/425

[58] Field of Search ..... 160/381, 371, 369; 49/425, 404; 16/97, 98, 99, 100, 105

[56] References Cited

U.S. PATENT DOCUMENTS

| | | | |
|---|---|---|---|
| 1,655,977 | 1/1928 | Schweig . | |
| 3,040,391 | 6/1962 | Saunders | 20/19 |
| 3,085,298 | 4/1963 | Metzger | 49/425 X |
| 3,153,805 | 10/1964 | Sterling et al. | 16/105 |
| 3,159,866 | 12/1964 | Kellems | 16/105 |
| 3,167,112 | 1/1965 | Tucker | 160/363 |
| 3,281,993 | 11/1966 | Riegelman | 16/99 X |
| 3,299,575 | 1/1967 | Shane | 16/99 X |
| 3,341,973 | 9/1967 | Miller | 16/97 X |
| 3,386,208 | 6/1968 | Banner | 49/420 |
| 3,442,052 | 6/1969 | Levine | 49/425 |
| 3,510,985 | 5/1970 | Smits | 49/425 |
| 3,526,995 | 9/1970 | Saunders | 49/420 |
| 3,619,947 | 11/1971 | Burum | 49/425 |
| 3,670,357 | 6/1972 | Steigerwald | 49/425 X |
| 3,714,738 | 2/1973 | Koslow et al. | 49/404 |
| 3,729,868 | 5/1973 | Burum | 49/425 X |
| 4,006,513 | 2/1977 | Offterdinger | 49/425 X |
| 4,030,160 | 6/1977 | Lambertz et al. | 16/105 |
| 4,123,874 | 11/1978 | Scott | 49/425 X |
| 4,262,451 | 4/1981 | Dallaire | 49/425 |
| 4,301,623 | 11/1981 | Demukai | 49/404 |
| 4,353,186 | 10/1982 | Offterdingr | 49/425 X |
| 4,633,151 | 1/1987 | Moose | 49/425 |
| 4,805,262 | 2/1989 | Marshik | 16/105 |
| 4,850,145 | 7/1989 | McAfee | 49/501 |
| 4,873,741 | 10/1989 | Reigelman | 49/425 X |

*Primary Examiner*—David M. Purol
*Attorney, Agent, or Firm*—James W. Grace

[57] ABSTRACT

An arcuately adjustable roller and corner key for sliding screen doors comprises a corner key having a hollow portion to receive a roller which is mounted on an axle. A pair of aligned arcuate slots in spaced sides of said hollow portion allow adjustable movement of said roller so that it can be used to form a right or left corner connector.

12 Claims, 2 Drawing Sheets

ARCUATELY ADJUSTABLE ROLLER AND CORNER KEY FOR SLIDING SCREEN DOOR

BACKGROUND OF THE INVENTION

1. Field of the Invention

This invention relates to a sliding screen door in which corner connectors incorporate arcuately adjustable rollers.

DESCRIPTION OF THE PRIOR ART

Screen doors are generally made of light aluminum or steel frame members which receive and hold a screen mesh. The frame members are connected together at 90° angles to form a four sided rectangle. In the screen doors which are designed for assembly on site, the frame members are pre-cut to a preselected length and have a corner connector inserted into each two adjacent frame members to form a rectangle.

The lower and upper horizontal frame members usually have grooved rollers which extend slightly outwardly of the edge of the frame member. The grooved rollers ride on tracks which line the upper and lower parts of the door opening.

In the prior art, the rollers generally have been spring loaded and have adjusting screw mechanisms associated with them to position them on the tracks when the screen doors are mounted in the door opening.

Such corner connectors and rollers may be seen in the prior art U.S. Pat. Nos. 3,040,391—Saunders, 3,167,112—Tucker, 3,386,208—Banner, 3,442,052—Levine, and 3,526,995—Saunders.

SUMMARY OF THE INVENTION

The present invention is directed to a sliding screen door in the form of a rectangle having rollers adjustable in arcuate slots in corner connectors. The conventional rollers located at the upper edge of the screen door are replaced by a guide bar. In addition, the conventional grooved rollers are replaced by rollers which have a flat periphery. However, in an alternative embodiment, the rollers of the invention may have grooves having a rectangular cross-section to reduce rolling friction.

OBJECTS OF THE INVENTION

It is an object of the present invention to provide a sliding screen door with corner connectors incorporating rollers adjustable in arcuate slots.

It is another object of the present invention to provide a sliding screen door which does not require rollers along the upper edge of the upper horizontal frame member.

It is yet another object of the present invention to provide a sliding screen door which can be easily assembled on the site with a minimum of parts.

BRIEF DESCRIPTION OF THE DRAWINGS

The foregoing and other objects, advantages and features of construction will become apparent to those skilled in the art from a consideration of the following detailed description of the invention taken, in conjunction with the accompanying drawings in which like elements are represented by like numbers in which:

Referring now to FIG. 1, there is shown one corner of a sliding screen door in which a corner connector 10 receives adjacent rectangular frame members to form a 90° corner. To complete a rectangular screen a similar corner connector is used at each of the other three corners to hold other frame members in secure positions. A screen mesh (see FIG. 7) is held in place by the frame members and the corner connectors, and covers the interior area of the frames to form a screen door. Corner connector 10 may be made of cast aluminum or hard plastic material, such as, calcium filled polypropylene. Corner connector 10 is in the form of an L-shaped body with legs 12 and 14 being at right angles to each other. Legs 12 and 14 have extensions 16 and 18 which are slightly smaller than the main body of corner connector 10 to accommodate hollow rectangular aluminum frames 20 and 22 which slip over extensions 16 and 18. Frames 20 and 22 are cut at right angles to their length and when assembled together with corner connector 10 do not overlap the main body of the corner connector. The corner connector 10 is thus exposed at each corner.

Figure 2:
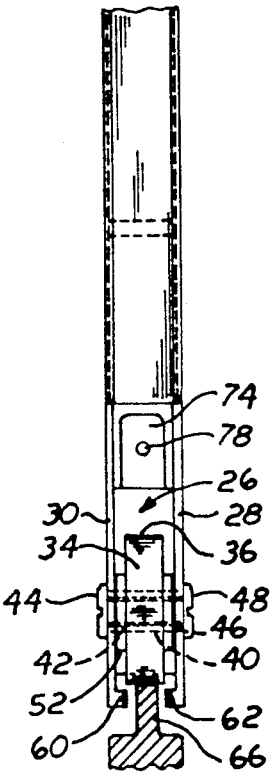
FIG. 2 is an end elevational view of the corner connector of the invention, taken along lines 2—2 of FIG. 1.
Figure 1:
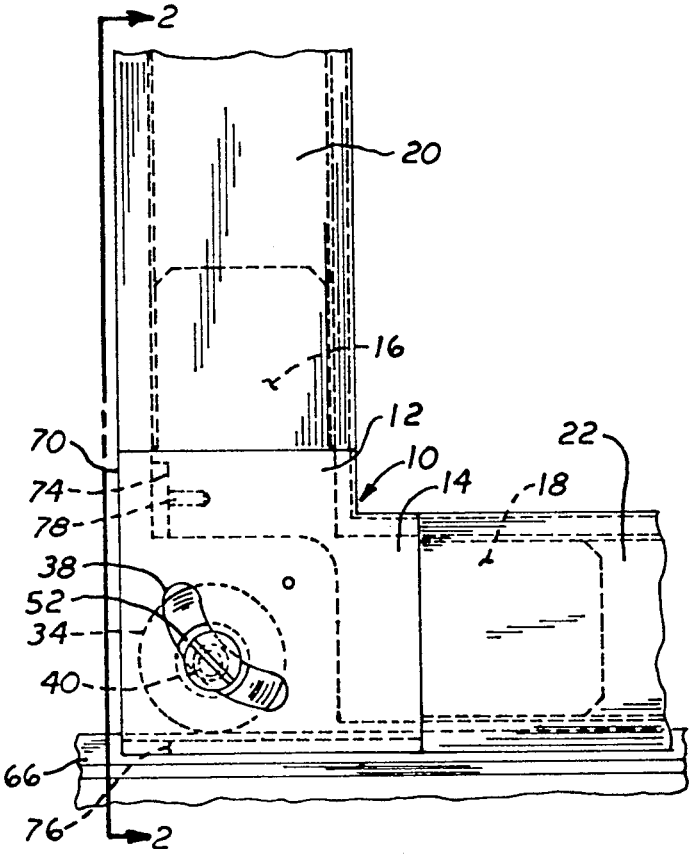
FIG. 1 is a side elevational view of the corner connector or the invention.

As may be seen in FIG. 2, corner connector 10 has a hollow interior portion 26 having spaced sides 28 and 30 to accommodate a roller 34 which has a flat peripheral surface 36. Referring again to FIG. 1, sides 28 and 30 of connector 10 have parallel corresponding arcuate slots 38 which provide a track to accommodate an axle 40 around which roller 34 is free to rotate.

Roller 34 may be of hard plastic such as calcium filled polypropylene and is in the form of a cylinder having a central round opening. The central round opening permits roller 34 to rotate around a cylindrical axle 40.

Figure 3:
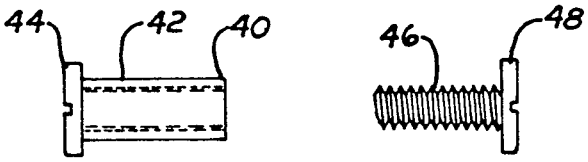
FIG. 3 is a side elevational view of a component of the corner connector of the present invention.

Referring to FIG. 3 axle 40 is formed by a hollow internally threaded cylinder 42 having a head 44, and an externally threaded bolt 46 having a head 48. Each head 44 and 48 is slotted to receive the blade of a conventional screw driver. Internally threaded cylinder 42 receives externally threaded bolt 46 to form a cylindrical axle 40 around which roller 34 rotates. It is not necessary that both heads 44 and 48 have slots.

In order to prevent binding of the roller 34 by sides 28 and 30 when axle 40 is tightened in place, a spacer 52 which is a cylindrical plastic tube which surrounds axle 40 and lies interiorly of the central round opening of roller 34. The length of spacer 52 is slightly greater than the length of roller 34 so that roller 34 will be free to rotate without contacting sides 28 and 30 of corner connector 10 when cylinder 42 and bolt 46 are tightened together.

Reference may be had to FIG. 2 to illustrate the assembly of roller 34 and axle 40 between sides 28 and 30 of corner connector 10. To mount roller 34 for movement along the length of slots 38, cylinder 42 is inserted through side 30 of corner connector 10 through arcuate slot 38. As cylinder 42 is moved inwardly of slot 38, the roller 34 with spacer 52 inserted in the central round opening of roller 34 is slipped into the space 26 between walls 28 and 30 and cylinder 42 is pushed through spacer 52. Cylinder 42 is further pushed into hollow portion 26 toward side 28 through the hollow center of spacer 52. After the end of cylinder 42 emerges through slot 38 in side 28, externally threaded bolt 46 is threaded into the hollow portion of cylinder 42. Bolt 46 is turned to form axle 40 and to move sides 28 and 30 into contact with spacer 52 around which roller 34 rotates.

Referring again to FIG. 2, the lower edges of sides 28 and 30 terminate with internally directed flanges 60 and 62 which act as guides to insure that the track 66 which lies along the bottom of the door opening is held centrally with respect to the peripheral surface 36 of roller 34. The weight of the sliding screen door keeps the door on track 66 as it is guided by internally facing flanges 60 and 62.

It should be realized that bottom horizontal framing member 22, which extends away from the corner connector toward the next spaced corner connector, has a longitudinal opening which will receive track 66. Of course, the longitudinal opening along the bottom of the horizontal framing member 22 does not require internally facing flanges corresponding to flanges 60 and 62 but the opening in the bottom of the horizontal framing member 22 need only be wide enough and deep enough to accommodate track 66.

Along the vertical left-hand side 70 of corner connector 10 is cut a vertical slot 74 which extends along the outer vertical edge of corner connector 10 and opens at the bottom corner 76 of the corner connector. A screw receiving hole 78 is drilled into the vertical edge of corner connector 10 near the upper edge thereof is located centrally of slot 74.

Figure 5:
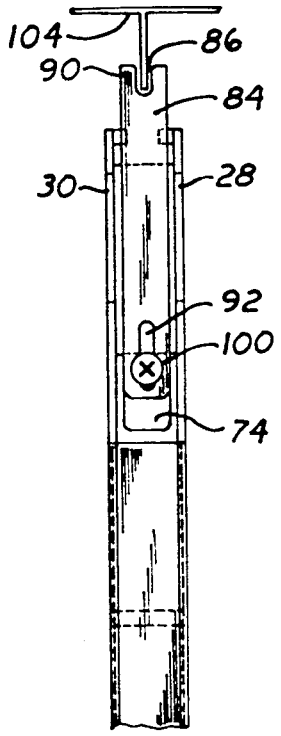
FIG. 5 is an end elevational view of a corner connector of the present invention.
Figure 4:
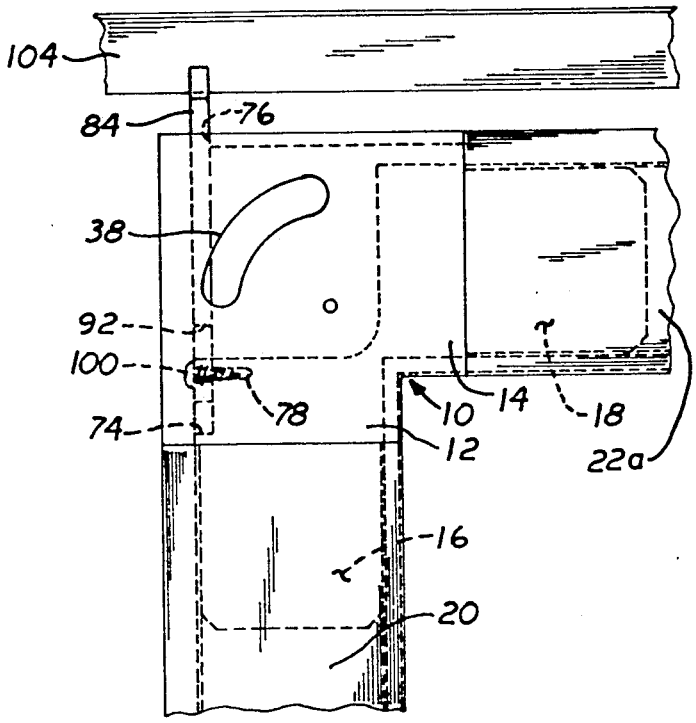
FIG. 4 is a side elevational view of a corner connector of the present invention.

The purpose of slot 74 and hole 78 will become apparent with reference to FIGS. 4 and 5 which illustrate a top corner connector of the screen door.

An aluminum or plastic strip 84 is mounted in vertical slot 74 of corner connector 10. Strip 84 is a long, narrow strip having a slot 86 in its head 90. Strip 84 has a vertical, elongated slot 92 adapted to receive a screw 100 which is screwed into hole 78. Using slot 92, strip 84 may be adjusted upwardly or downwardly to accommodate an overhead track 104. Track 104 is fixed along the upper part of the door opening and is parallel to track 66 along the lower edge of the screen door. In this configuration, roller 34 and its attendant mounting elements may be eliminated.

Figure 6:
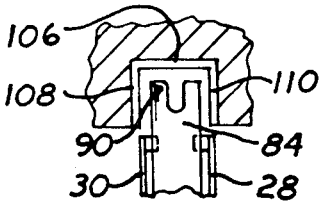
FIG. 6 is an end elevational view of an alternative track along the top of a door opening.

In FIG. 6 strip 84 has, in effect, a flat, square head 90 which can be accommodated in an alternative track 106 having depending sides 108 and 110. If desired, strip 84 may be reversed so that the lower end of strip 84 is exposed above the upper edge of corner connector 10.

Thus, strip 84 can be used with either a rectangular channel track or a vertical overhead rail track depending upon the nature of the opening at the horizontal top of the door opening.

Because the corner connector 10 has an arcuate slot 38, the position of roller 34 can be easily moved to form a right or left hand corner connector. Also, the position of roller 34 in the slot can be adjusted from either side of the screen door since both cylinder 42 and threaded bolt 46 have slotted heads and are reachable from either inside or outside the screen door.

Further, rollers 34 in each of the bottom corner connectors can be adjusted in slots 38 to level the sliding screen door.

Figure 7:
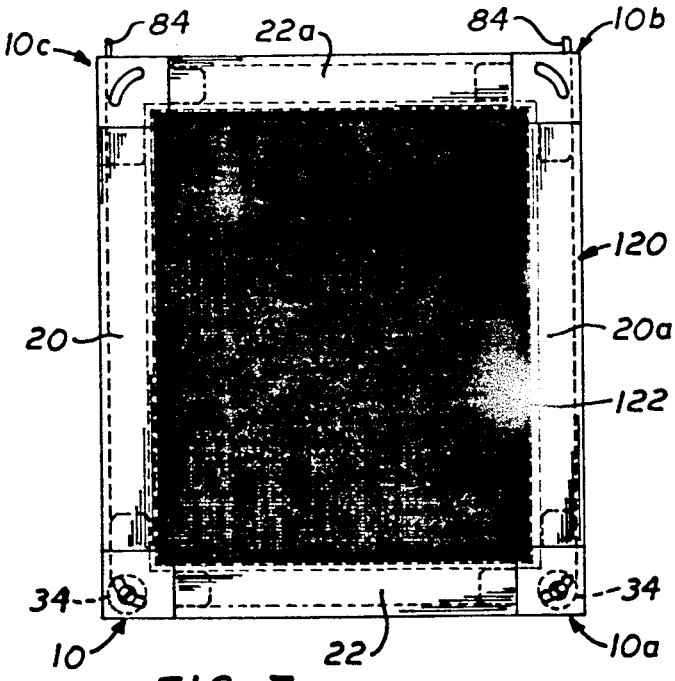
FIG. 7 is a side view of a sliding screen door made in accordance with the present invention.

Referring now to FIG. 7 there is shown a completed sliding screen door 120 with elongated frames 20, 22, 20*a* and 22*a*. Corner connectors 10, 10*a*, 10*b* and 10*c* are located at respective corners of screen door 120 and engage frames 20, 22, 20*a* and 22*a* to form a rigid rectangular structure. A screen mesh 122 is held in place in grooves (not shown) in the frames and corner connectors to cover the opening formed by the interior edges of the frames and corner connectors. The assembly of sliding screen door 120 is accomplished by techniques commonly known in the sliding screen door manufacturing and assembly trade.

Figure 8:
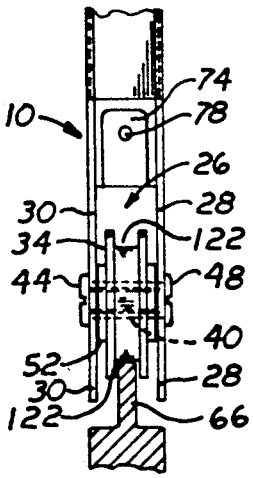
FIG. 8 is an end elevational view of an alternative corner connector of the invention.

As an alternative construction, the periphery of roller 34 need not be flat, but may cut to form a centered groove 122 of rectangular cross-section as shown in FIG. 8. In this way, corner connector 10 does not need flanges 60 and 62 but roller 34 will ride on the top of track 66 without falling off. The use of a rectangular cross-section for the centered groove of roller 34 reduces rolling friction as opposed to a U-shaped groove shown in the prior art.

The present embodiments of the invention are illustrative and should not be considered as restrictive of the scope of the invention being indicated by the appended claims.

I claim:

1. A corner connector for a sliding screen door comprising an L-shaped body, having a main portion and legs extending at right angles to said main portion, said legs being adapted to being inserted into rectangular tubular frame members, a portion of said main portion being hollow with opposed sides, an arcuate-shaped slot in each of said sides, said arcuate-shaped slots being aligned with each other, a roller journaled across said slots, said roller being adjustable in different positions along said slots whereby that said corner connector is capable of being used at either the right- or left-hand edge of said screen door.

2. A corner connector for a sliding screen door as recited in claim 1, in which a cylinder is secured between said slots, said cylinder acting as an axle for said roller to permit rotational motion of said roller.

3. A corner connector for a sliding screen door as recited in claim 2, in which said corner connector further has a cylindrical spacer, said cylindrical spacer being slightly longer than said roller and being mounted between said cylinder and said roller to prevent binding of said roller by said sides when said cylinder is tightened in place.

4. A corner connector for a sliding screen door as recited in claim 2 in which said cylinder comprises an outer hollow cylinder having internal threads and an inner bolt having external threads, at least one of said hollow cylinder and said bolt having an externally slotted head.

5. A corner connector as recited in claim 3 in which both said hollow cylinder and said bolt have slotted heads.

6. A corner connector for a sliding screen door as recited in claim 1, in which said roller has a flat periphery.

7. A corner connector for a sliding screen door as recited in claim 1, in which said roller has a groove in said periphery of said roller, said groove having a rectangular cross-section.

8. A corner connector for a sliding screen door as recited in claim 1, in which each of said sides has an internally facing flange along the outer edge of each of said sides.

9. A corner connector for a sliding screen door comprising an L-shaped body, having a main portion and a pair of outwardly extending legs, said legs being adapted to receive hollow framing members to form a corner of a sliding screen door, said main portion having a first and a second edge at right angles to one another, said L-shaped body further having a first slot cut into and extending longitudinally along said first edge of said main portion, said slot opening outwardly at said second edge of said main body, a strip having an elongated slot inserted in said first slot, a fastener extending through said elongated slot into said main portion, whereby said strip is capable of extending outwardly beyond said second edge of said main body.

10. A corner connector for a sliding screen door as recited in claim 9, in which said strip has a groove in one end of said strip and said strip is adapted to receive a track in said groove.

11. A sliding screen door comprising four interengaged frame members and four corner connectors in which at least two of said corner connectors are corner connectors, each of said corner connectors comprising an L-shaped body, having a main portion and legs extending at right angles to said main portion, said legs being adapted to being inserted into rectangular tubular frame members, a portion of said main portion being hollow with opposed sides, an arcuate-shaped slot in each of said sides, said arcuate-shaped slots being aligned with each other, a roller journaled across said slots, said roller being adjustable in different positions along said slots whereby that said corner connector is capable of being used at either the right- or left-hand edge of said screen door.

12. A sliding screen door comprising four interengaged frame members and four corner connectors in which at least two of said corner connectors comprise an L-shaped body having a main portion and legs extending at right angles to said main portion, said legs being adapted to being inserted into rectangular tubular frame members, a portion of said main portion being hollow with opposed sides, an arcuate-shaped slot in each of said sides, said arcuate-shaped slots being aligned with each other, a roller journaled across said slots, said roller being adjustable in different positions along said slots whereby that said corner connector is capable of being used at either the right- or left-hand edge of said screen door, and at least two of said corner connectors comprise an L-shaped body having a main portion and a first slot cut into and extending longitudinally along one side of said main portion, said slot opening outwardly on one edge of said main body, a strip having an elongated slot inserted in said first slot, a fastener extending through said elongated slot into said main body, whereby said strip is capable of extending outwardly beyond said one edge of said main body.

* * * * *